US007631509B2

(12) United States Patent
Shavit

(10) Patent No.: US 7,631,509 B2
(45) Date of Patent: Dec. 15, 2009

(54) INTEGRATED FREEZER-ANTEROOM CONTROL

(76) Inventor: Gideon Shavit, 2696 Summit Ave., Highland Park, IL (US) 60035

( * ) Notice: Subject to any disclaimer, the term of this patent is extended or adjusted under 35 U.S.C. 154(b) by 791 days.

(21) Appl. No.: 11/115,739

(22) Filed: Apr. 27, 2005

(65) Prior Publication Data

US 2006/0242972 A1 Nov. 2, 2006

(51) Int. Cl.
*F25B 21/00* (2006.01)
*F25D 17/04* (2006.01)

(52) U.S. Cl. ..... 62/150; 62/187; 62/440; 236/44 C; 236/49.3; 454/195

(58) Field of Classification Search ..... 62/93, 62/150, 151, 187, 440, 176.6; 236/44 C, 236/49.3; 454/195, 239, 258
See application file for complete search history.

(56) References Cited

U.S. PATENT DOCUMENTS 2,588,355 A 3/1952 Burr et al.
3,326,012 A * 6/1967 Asker et al. ..... 62/78
4,183,224 A * 1/1980 Rule et al. ..... 62/91
4,516,482 A * 5/1985 Smith ..... 454/191
4,669,278 A * 6/1987 Lee et al. ..... 62/380
5,538,471 A * 7/1996 Guiles, Jr. ..... 454/238
6,106,387 A * 8/2000 Smith ..... 454/190
6,525,659 B2 * 2/2003 Jaffe et al. ..... 340/545.6
6,595,429 B1 * 7/2003 Carlson et al. ..... 236/44 R
2001/0047658 A1 12/2001 Forrest et al.
2003/0019228 A1 * 1/2003 Bilyeu ..... 62/229
2003/0041614 A1 3/2003 Burn
2003/0234725 A1 * 12/2003 Lemelson et al. ..... 340/521
2004/0123612 A1 7/2004 Pham et al.
2004/0236463 A1 * 11/2004 Weselak et al. ..... 700/214
2006/0150659 A1 * 7/2006 Sidor et al. ..... 62/378
2008/0233859 A1 * 9/2008 Smith et al. ..... 454/188

FOREIGN PATENT DOCUMENTS

JP 09089346 A * 4/1997
JP 2000055486 A * 2/2000

OTHER PUBLICATIONS

Machine translation JP-09-089346 Inventor Mantani.*
Machine translation JP-200-055486 Inventor Masunaga.*
Chapter 12—"Refrigeration Load", 2002 ASHRAE Refrigeration Handbook, pp. 12.1-12.7.

* cited by examiner

*Primary Examiner*—Marc E Norman
(74) *Attorney, Agent, or Firm*—Schiff Hardin LLP

(57) ABSTRACT

Frost in a freezer and/or traffic between the freezer and an anteroom is controlled. The frost is controlled by estimating a condition of the anteroom that promotes the frost in the freezer and by opening a door in the doorway in response to the estimated condition in order to supply cold air from the freezer to the anteroom. The traffic between the freezer and the anteroom is controlled by detecting the traffic approaching the doorway and by opening the door in the doorway in response to the detected traffic.

35 Claims, 3 Drawing Sheets

INTEGRATED FREEZER-ANTEROOM CONTROL

TECHNICAL FIELD OF THE INVENTION

The present invention relates to the control of traffic and/or an environmental condition in a structure having both a cold storage room and an anteroom of the cold storage room. For convenience, the cold storage room will be referred to herein as a freezer. However, it should be understood that the present invention relates to any cold storage rooms including freezers.

BACKGROUND OF THE INVENTION

The demand for frozen or refrigerated goods has resulted in a concomitant demand for refrigerated storage facilities. A variety of refrigerated storage facilities have been used to store refrigerated goods.

For example, freezers have been equipped with doors that provide access to such freezers from loading docks or other adjacent spaces. Such doors can be opened and closed manually or automatically to allow vehicle and pedestrian traffic access to the freezers. Such doors are intended to permit refrigerated goods to be moved into and out of the freezers with increased energy efficiency.

However, traffic through such doors is frequently heavy, particularly at peak periods of the day. Accordingly, during these peak periods, the doors are necessarily open for large amounts of time, and many doors are kept open continuously during such peak traffic periods. Such open doors can present problems both with regard to the operation and maintenance of refrigeration equipment and with regard to the productivity and safety of the facility.

As has been recognized, an open door to a refrigerated space permits the heavier refrigerated air to flow out of the refrigerated space through the lower portion of the door opening and a more or less equal mass of warm humid air to flow inward through the upper portion of the door opening. The warm air entering the refrigerated space is typically referred to as infiltration air, and the cold air escaping the refrigerated space is typically referred to as exfiltration air.

When a warm, more humid air mass encounters a cold, less humid air mass, precipitation commonly occurs. This precipitation is in the form of water droplets on the warm side of the door and air born ice crystals in the freezer.

Air born ice crystals in the freezer is usually visible as haze, while visible fog frequently appears on the warm side of the door as cold air escapes from the lower portion of the door opening and mixes with the warmer humid outside air. Fog can obstruct the vision of personnel, including vehicle operators, working in the area. In addition, water droplets on the warm side of the door frequently causes wet slippery floors in the vicinity of the door with consequent hazards not only to personnel but also to equipment and material.

Air born ice crystals in the freezer result in frost or snow accumulation on ceilings, walls, freezer room appurtenances, and on the goods stored in the room. Frost can grow to many inches in thickness and can result in icy floors that present extremely slippery and hazardous conditions for personnel and for vehicles such as forklift trucks. Further, air born ice crystals may be drawn into the refrigeration equipment and produce premature clogging of the coils of the equipment, thereby reducing the refrigeration effect and adding to the burden of defrosting the coils. The result is a substantial reduction in refrigeration efficiency and may require installation of additional evaporator coils or oversized refrigeration equipment.

Many attempts have been made to reduce air exchange through open doors of refrigerated spaces. One common approach employs an air curtain across the doorway opening. The forced flow of relatively high velocity air of the air curtain across the opening serves to restrict the normal air exchange that results due to the temperature differential across the doorway. This forced flow of relatively high velocity air also serves to mix any cold air escaping from the freezer through the air curtain with the air in the high velocity air stream. Thus, the escaping cold air is diluted which reduces the precipitation rate.

It is also known to heat the air used in such air curtains thereby further reducing precipitation both inside and outside the refrigerated space.

Air curtains, however, are expensive to install and use, and do not of themselves result in energy efficient and low frost operation.

Air conditioned vestibules and anterooms have also been used. The conditions in these vestibules and anterooms can be controlled somewhere between outside air conditions and the conditions inside the freezer in order to reduce the water and frost problems described above. However, vestibules and anterooms have not been also controlled so as to efficiently use energy and minimize frost in the freezer.

Air curtains have been combined with vestibules and anterooms. Such arrangements, while effective in reducing precipitation in both the freezer and the vestibule or anteroom, are expensive to install.

Strip doors have also been used to restrict the flow of air through an open door of a freezer. Such strip doors typically employ transparent vinyl strips. These strips part when personnel and vehicles pass through them, and they then quickly fall back into place when personnel and vehicles clear them. These strips, therefore, act as an air flow barrier.

However, strip doors do not sufficiently reduce frost in the freezer and the consumption of energy. The use of strip doors is also objectionable because the strips tend to become less transparent with use and age, and may, therefore, obstruct vision. Further, frost or fog condensation on the strip surfaces not only obstructs vision, but the wet, cold surfaces are generally considered objectionable by personnel passing through the door. The relatively heavy plastic strips can also drag lightweight items such as empty cartons from material handling equipment.

The present invention overcomes one or more of these or other problems.

SUMMARY OF THE INVENTION

According to one aspect of the present invention, a method is provided to control the dew point temperature in an anteroom separated from a cold storage room by a doorway. The method comprises the following: determining a value for the dew point temperature in the anteroom; and, supplying cold air from the cold storage room to the anteroom in response to the value of the dew point temperature in the anteroom.

According to another aspect of the present invention, a method is provided to reduce frost formation in a cold storage room separated from an anteroom by a doorway. The method comprises the following: estimating a condition of the anteroom that promotes no frost in the cold storage room while substantially minimizing heat addition to the cold storage room; and, supplying cold air from the cold storage room to the anteroom in response to the estimated condition.

According to still another aspect of the present invention, a method is provided to reduce frost formation in a cold storage room separated from an anteroom by a doorway and to control traffic between the cold storage room and the anteroom. The method comprises the following: detecting traffic approaching the doorway; opening a door in the doorway in response to the detected traffic; estimating a condition of the anteroom that promotes no frost in the cold storage room while substantially minimizing heat addition to the cold storage room; and, opening the door in the doorway in response to the estimated condition in order to supply cold air from the cold storage room to the anteroom.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
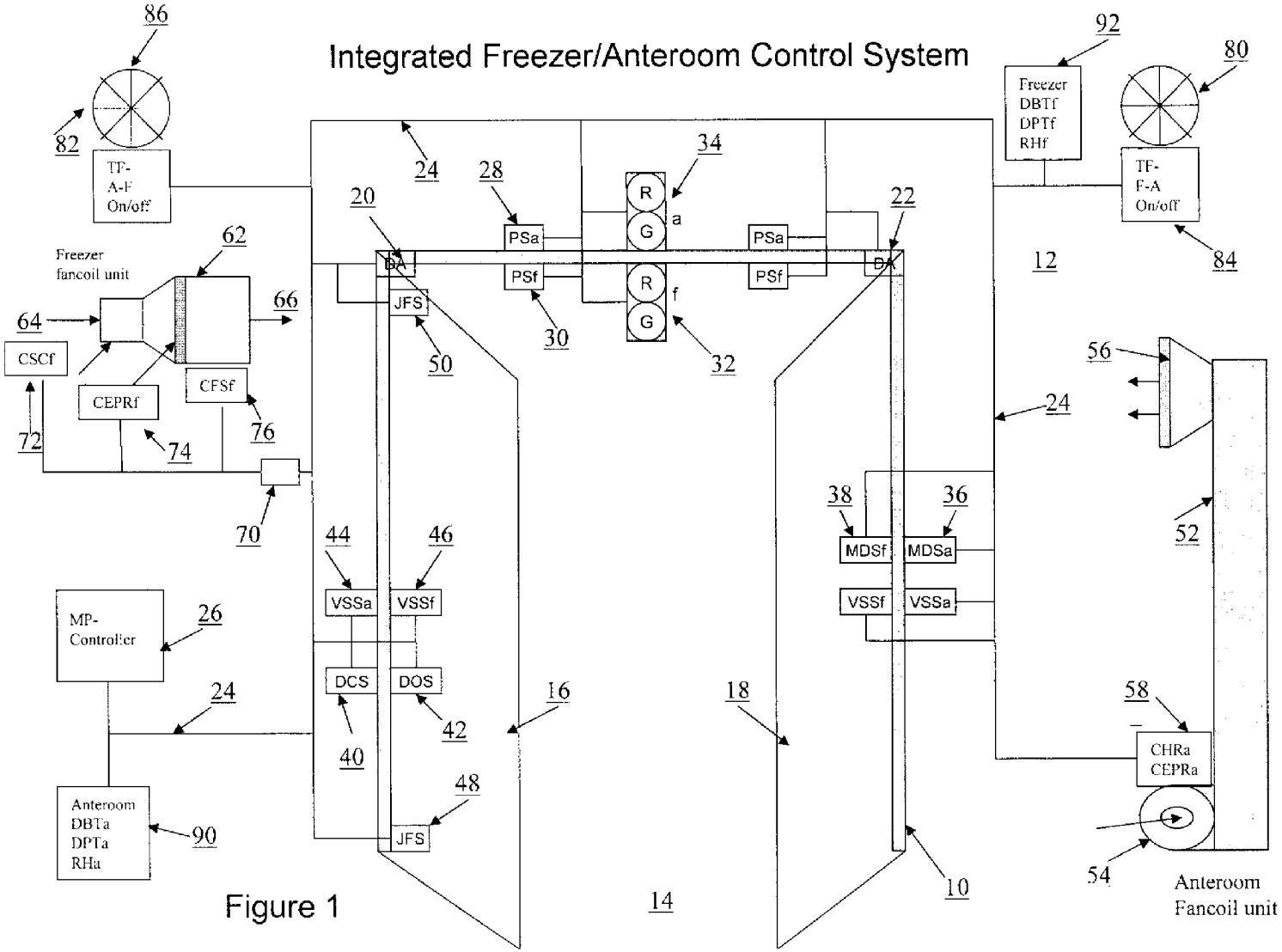
FIG. 1 shows a freezer and an anteroom with a door separating the two rooms and also shows a control system that controls the door and the conditions within the two rooms; and, FIGS. 2A and 2B comprise a flow chart of a program executed by the control system of FIG. 1.

As shown in FIG. 1, a door 10 separates a freezer 12 from an anteroom 14. As viewed in FIG. 1, the freezer 12 is behind the door 10, the anteroom 14 is in front of the door 10, and the door 10 has door panels 16 and 18 that open into the anteroom 14.

The freezer 12 is sufficiently large to permit a desired amount of refrigerated goods to be stored inside, and may be large enough to accommodate a motorized vehicle to assist in moving the refrigerated goods into and out of the freezer 12. The anteroom 14 is sufficiently large to permit movement of refrigerated goods therethrough, and may be large enough to accommodate movement of a motorized vehicle carrying refrigerated goods.

The door 10 is preferably, although not necessarily, a fast acting rigid door with a viewing window to provide a field of view of the freezer 12 from a vantage point within the anteroom 14 and a field of view of the anteroom 14 from a vantage point within the freezer 12. The normal position of the door 10 is the closed position.

Although the door 10 can be of any desired configuration, the door 10 as shown in FIG. 1 has the panels 16 and 18 that are operated by corresponding actuators 20 and 22 coupled by a bus 24 to a system controller 26. The actuators 20 and 22 are arranged to open the door 10 so that the panels 16 and 18 swing into the anteroom 14.

A proximity sensor 28 is positioned to sense traffic in the anteroom 14 approaching the door 10 and is coupled by the bus 24 to the system controller 26 such as a microprocessor or other computer. A proximity sensor 30 is positioned to sense traffic in the freezer 12 approaching the door 10 and is coupled by the bus 24 to the system controller 26. Accordingly, in response to the proximity sensors 28 and 30, the system controller 26 opens the door 10 whenever traffic in either the freezer 12 or the anteroom 14 approaches the door 10.

Alternatively, motion sensors can be used in place of the proximity sensors 28 and 30 such that, whenever traffic in either the freezer 12 or the anteroom 14 is sufficiently close to enter the field of view of the corresponding motion sensor, the system controller 26 operates the actuators 20 and 22 to open the door 10. In order to enhance this alternative door control, distance sensors can be used in combination with the motion sensors so that the door 10 is opened when the traffic is at an optimum distance from the door 10.

Whenever two vehicles approach the door 10 at the same time, the system controller 26 may be arranged to give priority to the vehicle on a particular side of the door 10. For example, the vehicle in the freezer 12 may be given priority over the vehicle in the anteroom 14. Accordingly, collisions between vehicles are avoided.

A traffic light 32 is positioned to be seen by traffic in the anteroom 14 as the traffic approaches the door 10 and is coupled by the bus 24 to the system controller 26. A traffic light 34 is positioned to be seen by traffic in the freezer 12 as the traffic approaches the door 10 and is coupled by the bus 24 to the system controller 26. The traffic lights 32 and 34 may have any desired configuration that can be used to stop traffic and to permit traffic to proceed. For example, each of the traffic lights 32 and 34 may have a red light to stop traffic and a green light to indicate that traffic can proceed.

Accordingly, when traffic in the freezer 12 and in the anteroom 14 approach the door at roughly the same time, the traffic on the side of the door 10 having the higher priority is given the green light to proceed, and the traffic on the side of the door 10 having the lower priority is given the red light to stop.

A manual door switch 36 is positioned in the anteroom 14 near the door 10 and is coupled by the bus 24 to the system controller 26. Similarly, a manual door switch 38 is positioned in the freezer 12 near the door 10 and is coupled by the bus 24 to the system controller 26. Either of the manual door switches 36 and 38 can be operated at times when traffic volume is high in order to open the door 10 manually and to keep the door 10 in the open configuration. Alternatively, the system controller 26 can automatically control the stay open time of the door 10 during periods of time when traffic volume is high by employing a learning algorithm that learns time dependent traffic volumes based on outputs from the motion and/or proximity sensors.

A door closed sensor 40 senses when the door 10 is closed and is coupled by the bus 24 to the system controller 26. A door open sensor 42 senses when the door 10 is open and is coupled by the bus 24 to the system controller 26. The door closed sensor 40 and the door open sensor 42 provide feedback to the system controller 26 on the open and closed states of the door 10.

A traffic speed sensor 44 is positioned to sense the speed of traffic in the anteroom 14 and is coupled by the bus 24 to the system controller 26. Similarly, a traffic speed sensor 46 is positioned to sense the speed of traffic in the freezer 12 and is coupled by the bus 24 to the system controller 26. The traffic speed sensors 44 and 46 may be used by the system controller 26 in conjunction with the proximity sensors 24 and 30 to determine the optimum time to open the door 10 to permit traffic therethrough so as to maximum energy conservation.

A frost sensor 48 is provided in the anteroom 14 at floor level near the door 10, and a frost sensor 50 is provided in the freezer 12 near the top of the door 10. The frost sensors 48 and 50 are coupled by the bus 24 to the system controller 26.

A fan and coil unit 52 is located in the anteroom 14 and has a fan inlet 54 and a fan outlet 56. The fan and coil unit 52 conventionally includes an evaporator coil and a fan to blow air across the evaporator coil and into the anteroom 14. A fan and coil controller 58 includes a coil reheat relay and a coil evaporator pressure regulator relay for controlling the fan and coil unit 52. The fan and coil controller 58 is coupled by the bus 24 to the system controller 26.

A fan and coil unit 62 is located in the freezer 12 and has a fan inlet 64 and a fan outlet 66. The fan and coil unit 62 conventionally includes an evaporator coil and a fan to blow air across the evaporator coil and into the freezer 12. A fan and coil controller 70 includes a fan speed control 72 and a coil evaporator pressure regulator relay 74 for controlling the fan and coil unit 62. Also, a coil frost sensor 76 is positioned to sense frost build up on the evaporator coil of the fan and coil unit 62. The fan speed control 72, the coil evaporator pressure regulator relay 74, and the coil frost sensor 76 are coupled by the bus 24 to the system controller 26.

If desired, an air transfer fan 80 is provided to transfer air from the freezer 12 to the anteroom 14, and an air transfer fan 82 is provided to transfer air from the anteroom 14 to the freezer 12. A transfer fan controller 84, which may an on/off controller, is coupled by the bus 24 to the system controller 26 so that the system controller 26 can control the operation of the air transfer fan 80. Similarly, a transfer fan controller 86, which may an on/off controller, is coupled by the bus 24 to the system controller 26 so that the system controller 26 can control the operation of the air transfer fan 82.

Various other sensors are also coupled by the bus 24 to the system controller 26. Accordingly, a sensor package 90 is located in the anteroom 14 and may include a dry bulb temperature sensor, a relative humidity sensor, and/or a dew point temperature sensor. Similarly, a sensor package 92 is located in the freezer 12 and may include a dry bulb temperature sensor, a relative humidity sensor, and/or a dew point temperature sensor.

Thus, each of the sensor packages 90 and 92 may comprise any number of sensors. As an example, each of the sensor packages 90 and 92 may include two of the above described sensors because the condition sensed by the third sensor can be determined based on the other two sensed conditions and the psychometric chart. For example, dry bulb temperature and relative humidity can be used in combination with the psychometric chart to determine dew point temperature.

Because outdoor air infiltrates into the anteroom 14, the conditions in the anteroom 14 are not continuously at steady state. The dry bulb temperature (DBTa) and the dew point temperature (DPTa) in the anteroom 14, therefore, fluctuate. The system controller 26 reacts to these fluctuations so as to maintain the anteroom 14 at a desired dew point temperature (DPTa) and, thereby, minimize the creation of snow and ice build up in the freezer 12 and ice build up and condensation in the anteroom 14.

The system controller 26 determines the optimum operating conditions for the anteroom 14, and controls the anteroom 14 at these optimum operating conditions so that air infiltrating from the anteroom 14 into the freezer 12 will not cause fog, ice, and/or snow in the freezer 12. For example, the system controller 26 may be arranged to determine the optimum operating dew point temperature of the anteroom 14 and to control the anteroom 14 at this optimum operating dew point temperature so that air infiltrating from the anteroom 14 into the freezer 12 will not cause fog, ice, and/or snow in the freezer 12.

Additionally, the system controller 26, in response to the frost sensors 48 and 50, controls conditions in the anteroom 14 so that ice will not accumulate in the anteroom 14 at the bottom of the opening of the door 10 or in the freezer 12 at the top of the opening of the door 10.

Accordingly, the system controller 26 flags the fan and coil unit 52 in the anteroom 14 so as to cause the speed of the fan in the fan and coil unit 52 to increase to maintain better air circulation and mixing, and also flags the fan and coil unit 52 to convert to heating mode. When the ice from the opening of the door 10 is removed and the dry bulb temperature of the anteroom 14 is operating at set point, the system controller 26 flags the fan and coil unit 52 to operate at normal conditions.

Also, the system controller 26 is responsive to the coil frost sensor 76 that is positioned to sense frost build up on the evaporator coil of the fan and coil unit 62 in order to reduce this frost build up by increasing the speed of the fan of the fan and coil unit 62 and/or by increasing the surface temperature of the evaporator coil in the fan and coil unit 62 by increasing suction pressure.

The system controller 26 continuously monitors conditions in the anteroom 14. For example, when the actual dew point temperature in the anteroom 14 is above set point, the system controller 26 operates the actuators 20 and 22 to open the door 10 so as to dehumidify the anteroom 14. The door 10 can be maintained in this open condition until the actual dew point temperature in the anteroom 14 returns to set point. Additionally or alternatively, the door 10 can be maintained in this open condition for a time period determined by a heuristic algorithm, by a predetermined schedule, by a learning algorithm, or by a combination of these strategies. The cold air infiltrating into the anteroom 14 through the open door 10 mixes with the air in the anteroom 14 so that the mixture will be at the desired dew point temperature.

Additionally or alternatively, the air transfer fans 80 and 82 can be operated to control the mixing of cold air from the freezer 12 with the air in the anteroom 14. For example, in the case where the open door 10 cannot itself provide sufficient air infiltration to lower the dew point temperature of the anteroom 14 to set point, the system controller 26 can control the air transfer fans 80 and 82 to transfer additional cold air from the freezer 12 to the anteroom 14.

Moreover, the freezer 12 can be maintained at a set point dry bulb temperature (DBTf) and at a set point relative humidity (RHf). These set point conditions may change depending on the nature of the refrigerated goods.

Figure 2A:
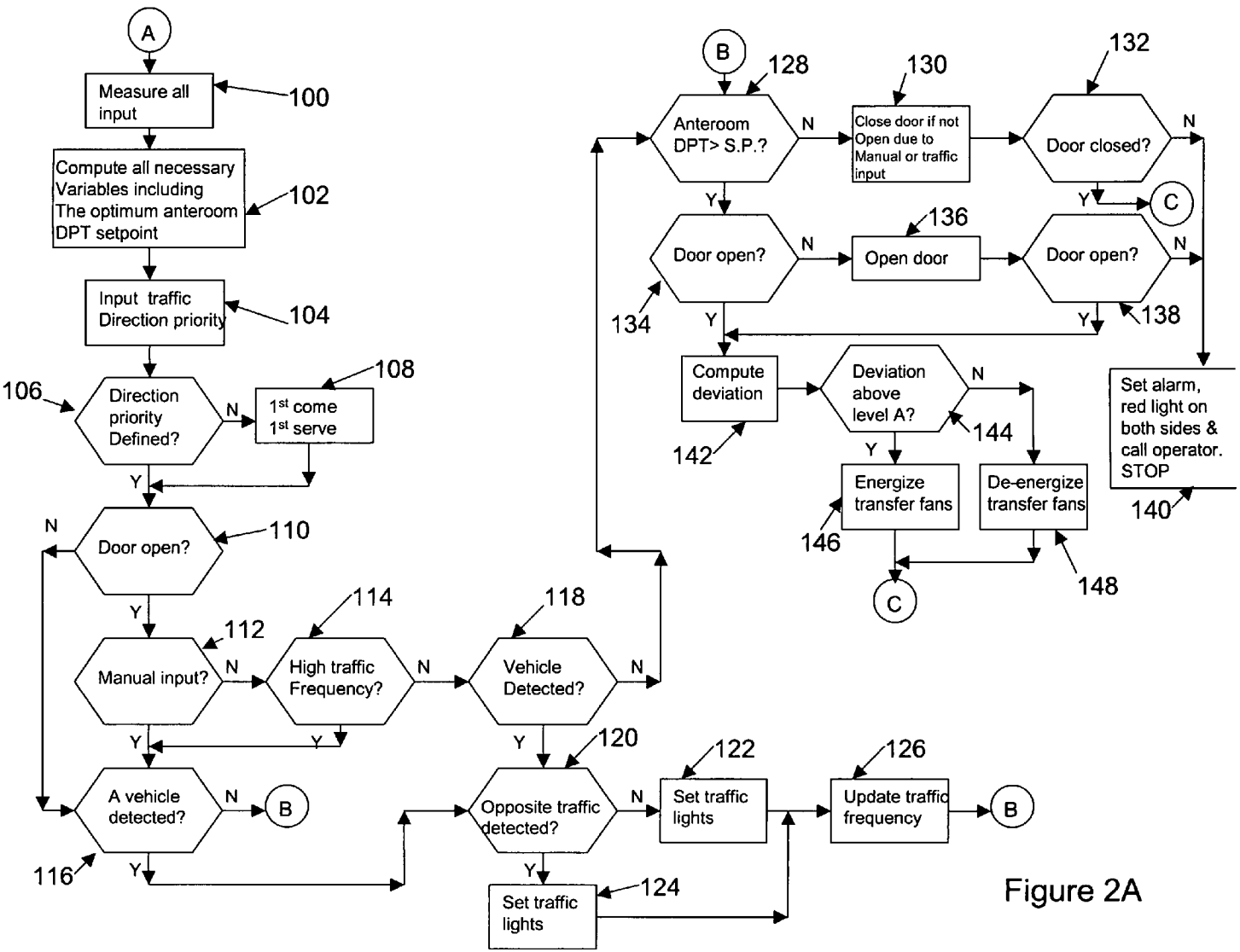
Figure 2B:
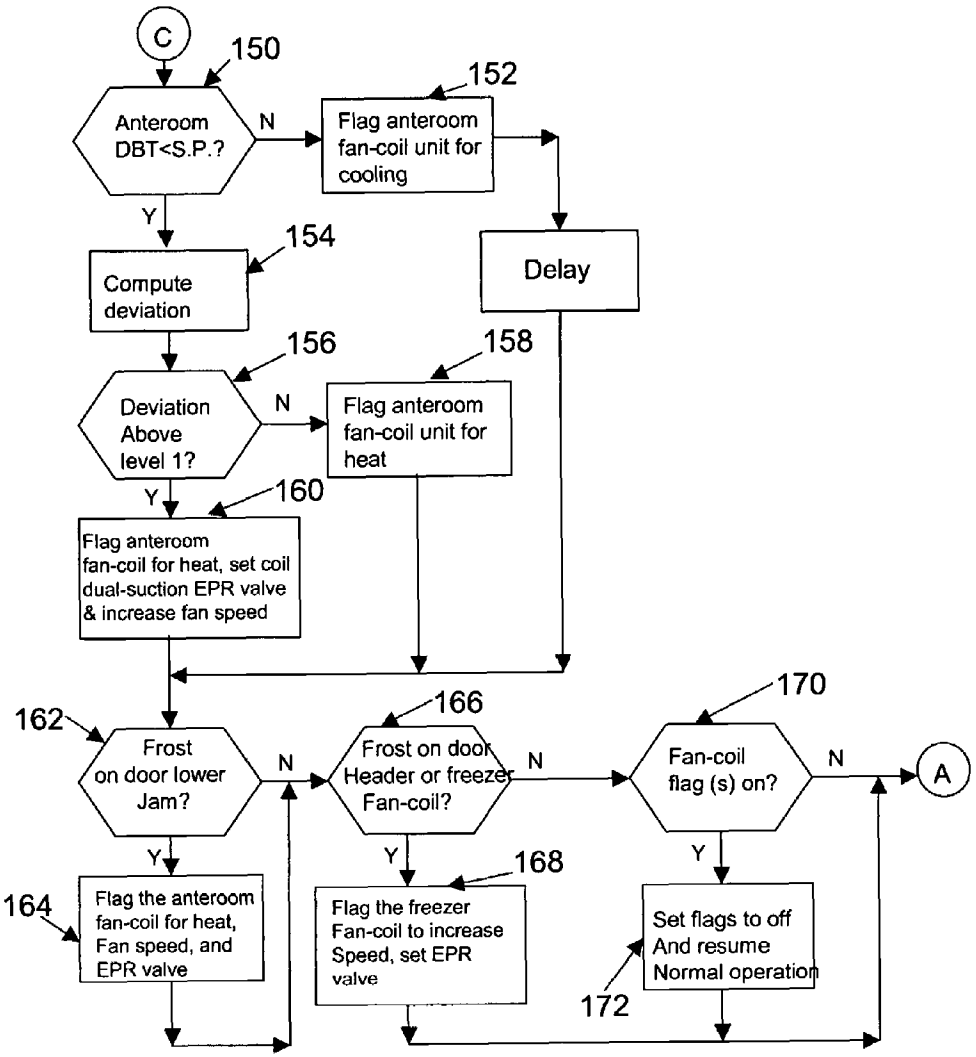

The flow chart of FIGS. 2A and 2B illustrates a program that can be executed by the system controller 26 in order to carry out the above described control functions. Accordingly, at a block 100, the conditions detected by the sensors described above are read.

The system controller 26, at a block 102, computes pertinent variables including the optimum dew point temperature for the anteroom 14. The psychometric chart, if desired, can be employed for this purpose. For example, given the set point dry bulb temperature and relative humidity of the freezer 12 and the relative humidity of the anteroom 14, the optimum dew point temperature for the anteroom 14 can be determined. For this purpose, a line, which may be referred to as the squall line, may be used. This line is tangent to the saturation curve of the psychometric chart and passes through the line indicated by the set point dry bulb temperature or relative humidity of the freezer 12. The optimum dew point temperature for the anteroom 14 can be determined from the point where the relative humidity line corresponding to the relative humidity of the anteroom 14 or the dry bulb line corresponding to the dry bulb temperature of the anteroom 14 crosses this squall line.

The set point dew point temperature for the anteroom 14 should be no higher than this optimum dew point temperature because, if the actual dew point temperature of the anteroom 14 is higher than this optimum dew point temperature, then frost, ice, and water conditions can result. The set point dew point temperature, for example, may be set equal to the optimum dew point temperature for the anteroom 14.

At a block 104, the system controller 26 notes the traffic direction, if any, that is given priority. This priority is defined by the user and can be stored in memory. According to the example given above, vehicles moving from the freezer 12 to the anteroom 14 may be given priority over vehicles moving from the anteroom 14 to the freezer 12. If the system controller 26 determines at a block 106 that the user has not assigned a priority to either traffic direction, the system controller 26 determines at a block 108 that the traffic will be controlled on a first come, first served basis.

If the system controller 26 determines at the block 106 that the user has assigned priority to one of the traffic directions, or after the system controller 26 determines at the block 108 that the traffic will be controlled on a first come, first served basis, the system controller 26 determines at a block 110 whether the door 10 is open. If the door 10 is open, the system controller 26 determines at a block 112 whether at least one of the manual door switches 36 and 38 has been operated. If neither of the manual door switches 36 and 38 has been operated, the system controller 26 determines at a block 114 whether the current time is a time when the volume of traffic is normally high.

If the system controller 26 determines at a block 110 that the door 10 is not open, or if the current time is a time when the volume of traffic is normally high, or if at least one of the manual door switches 36 and 38 has been operated, the system controller 26 determines at a block 116 whether a vehicle is detected. If a vehicle is not detected at the block 116, program flow proceeds through point B. If the current time is not a time when the volume of traffic is normally high as determined at the block 114, the system controller 26 determines at a block 118 whether a vehicle is detected.

If a vehicle is detected at either of the blocks 116 and 118, the system controller 26 determines at a block 120 whether there is traffic approaching the door 10 in both the freezer 12 and the anteroom 14. If traffic in only one of the freezer 12 and the anteroom 14 is approaching the door 10, the traffic light in the traffic room is turned to green and the traffic light in the non-traffic room is turned to red at a block 122. However, if traffic in both of the freezer 12 and the anteroom 14 is approaching the door 10, the traffic lights in the freezer 12 and the anteroom 14 are controlled at a block 124 based on the priority set by either the block 104 or the block 108.

After the traffic lights are controlled at the block 122 or the block 124, the system controller 26 updates the traffic volume data at a block 126. This data is used to model the time based traffic volume that is used by the block 114 as discussed above. Program flow then proceeds through point B.

If no vehicle is detected as determined at the block 116 or the block 118, or after the system controller 26 updates the traffic volume data at a block 126, the system controller 26 determines at a block 128 whether the actual dew point temperature in the anteroom 14 is above its set point.

If the actual dew point temperature in the anteroom 14 is not above its set point, a block 130 causes the door 10 to be closed if the door is not open due to traffic or operation of at least one of the manual door switches 36 and 38, and a block 132 checks the feedback that the door 10 is closed. If the door 10 is closed, program flow proceeds through point C. If the actual dew point temperature in the anteroom 14 is above its set point, a determination is made at a block 134 as to whether the door 10 is open. If the door 10 is not open, a block 136 causes the door 10 to be opened, and a block 138 checks to make sure that the door 10 is opened. If the door 10 in fact did not open as determined at the block 138, or if the door 10 did not close as determined at the block 132, a block 140 causes an alarm to be given, turns the traffic light on each side of the door 10 to red, calls the operator, and terminates program flow.

If the door 10 is determined to be open by the block 134 or the block 138, the deviation of the actual dew point temperature in the anteroom 14 from its set point is computed at a block 142, and a test is made at a block 144 to determine if the deviation is greater than a predetermined amount A. If the deviation is greater than a predetermined amount A, a block 146 causes the transfer fans to be energized to bring more air from the freezer 12 into the anteroom 14, and program flow thereafter proceeds through point C. If the deviation is not greater than a predetermined amount A, the open door is sufficient to return the actual dew point temperature in the anteroom 14 to its set point. Therefore, a block 148 causes the transfer fans, if on, to be de-energized, and program flow thereafter proceeds through point C.

After the block 146 causes the transfer fans to be energized, or after the block 148 causes the transfer fans, if on, to be de-energized, or if the door is closed at tested by the block 132, a determination is made at a block 150 as to whether the actual dry bulb temperature in the anteroom 14 is below its set point.

If the actual dry bulb temperature in the anteroom 14 is not below its set point, a block 152 flags the fan and coil unit 52 in the anteroom 14 to operate so as to cool the anteroom 14. If the actual dry bulb temperature in the anteroom 14 is below its set point, the deviation of the actual dry bulb temperature in the anteroom 14 from its set point is computed at a block 154, and a test is made at a block 156 to determine if the deviation is greater than a predetermined level 1. If the deviation is not greater than the predetermined level 1, a block 158 flags the fan and coil unit 52 in the anteroom 14 to operate so as to heat the anteroom 14. However, if the deviation is greater than the predetermined level 1, a block 160 flags the coil evaporator pressure regulator relay of the fan and coil unit 52 in the anteroom 14 to operate so as to increase suction pressure and increases the fan speed of the fan and coil unit 52.

After a delay following the block 152 flagging the fan and coil unit 52 in the anteroom 14 to operate so as to cool the anteroom 14, or after the block 158 flags the fan and coil unit 52 in the anteroom 14 to operate so as to heat the anteroom 14, or after the block 160 flags the coil evaporator pressure regulator relay of the fan and coil unit 52 in the anteroom 14 to operate so as to increase suction pressure and increases the fan speed of the fan and coil unit 52, a determination is made at a block 162 as to whether frost has built up on the lower jam of the door 10.

If frost has built up on the lower jam of the door 10, a block 164 flags the fan and coil unit 52 in the anteroom 14 to operate so as to heat the anteroom 14. The fan speed will increase as a function of the deviation from the set point. If additional heat is required, the EPR valve will be set to deliver a higher surface temperature to increase the temperature of the air exiting the fan outlet 56. After the block 164 flags the fan and coil unit 52 in the anteroom 14 to operate so as to heat the anteroom 14, or if frost has not built up on the lower jam of the door 10, a determination is made at a block 166 as to whether frost has built up on the top jam of the door 10 or on the evaporator coil of the fan and coil unit 62.

If frost has built up on the top jam of the door 10 or on the evaporator coil of the fan and coil unit 62, a block 168 flags the speed of the fan of the fan and coil unit 62 to increase and/or flags the coil evaporator pressure regulator relay of the fan and coil unit 62 to operate so as to increase suction pressure.

If frost has not built up on the top jam of the door 10 or on the evaporator coil of the fan and coil unit 62, a test is made at a block 170 to determine if any of the fan coil units have been flagged on. If so, a block 172 flags the fan coils off.

After a block 168 flags the speed of the fan of the fan and coil unit 62 to increase and/or flags the coil evaporator pressure regulator relay of the fan and coil unit 62 to operate so as to increase suction pressure, or after the block 170 determines that the fan coils have not been flagged on, or after the block 172 flags the fan coils off, program flow returns to the beginning of the algorithm shown in FIGS. 2A and 2B.

Modifications of the present invention will occur to those practicing in the art of the present invention. For example, as described above, fans and/or doors are used to control air flow between the freezer 12 and the anteroom 14. Additionally or alternatively, other devices can be used to air flow between the freezer 12 and the anteroom 14.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A method of controlling the moisture level in an anteroom and a cold storage room separated by a doorway, the method comprising:

determining a moisture level in the anteroom; and, supplying cold air from the cold storage room to the anteroom in response to the determined moisture level in the anteroom so as to reduce ice build up in the cold storage room and condensation in the anteroom.

2. The method of claim 1 wherein the determining of a moisture level in the anteroom comprises determining a value for the dew point temperature in the anteroom, and wherein the supplying of cold air from the cold storage room to the anteroom comprises supplying cold air from the cold storage room to the anteroom in response to the value of the dew point temperature in the anteroom.

3. The method of claim 2 wherein the supplying of cold air from the cold storage room to the anteroom comprises opening a door in the doorway to permit cold air from the cold storage room to enter the anteroom.

4. The method of claim 2 wherein the supplying of cold air from the cold storage room to the anteroom comprises energizing at least one transfer fan to transfer cold air from the cold storage room to the anteroom.

5. The method of claim 4 wherein the supplying of cold air from the cold storage room to the anteroom further comprises opening a door in the doorway to permit cold air from the cold storage room to enter the anteroom.

6. The method of claim 4 wherein the energizing of at least one transfer fan to transfer cold air from the cold storage room to the anteroom is performed only if the dew point temperature in the anteroom exceeds a set point by a predetermined amount.

7. The method of claim 2 further comprising:

detecting frost near the doorway; and, controlling a fan coil unit in the anteroom to heat in response to the detected frost.

8. The method of claim 2 further comprising:

detecting frost on a coil of a cooling apparatus located in the cold storage room; and, increasing the speed of a fan of the cooling apparatus in response to the detected frost.

9. The method of claim 2 further comprising:

detecting frost near the doorway; and, operating a coil evaporator pressure regulator relay of a cooling apparatus in the cold storage room to increase suction pressure in response to the detected frost.

10. The method of claim 2 further comprising controlling a fan coil unit in the anteroom to heat if the dew point temperature in the anteroom is less than a set point by a predetermined amount.

11. The method of claim 2 wherein the dew point temperature comprises an actual dew point temperature of the anteroom, and wherein the supplying of cold air from the cold storage room to the anteroom comprises supplying cold air from the cold storage room to the anteroom when the actual dew point temperature of the anteroom is greater than an optimum dew point temperature for the anteroom.

12. The method of claim 11 wherein the optimum dew point temperature is selected to prevent frost in the cold storage room.

13. The method of claim 11 further comprising:

determining a dry bulb temperature of the cold storage room;

determining a relative humidity of the cold storage room; and, determining the optimum dew point temperature according to a line on the psychometric chart, wherein the line passes through a first point established by the dry bulb temperature and the relative humidity of the cold storage room, wherein the line is tangent to the saturation curve of the psychometric chart, wherein the optimum dew point temperature is determined from a second point on the line established by the intersection of the tangent line and the desired anteroom dry bulb temperature line.

14. The method of claim 13 wherein the dry bulb temperature of the cold storage room comprises a set point dry bulb temperature for the cold storage room.

15. The method of claims 1 further comprising:

detecting traffic approaching the doorway; and, opening a door in the doorway in response to the detected traffic.

16. The method of claim 15 further comprising controlling traffic lights in response to the detected traffic.

17. The method of claim 15 further comprising maintaining the door in an opened condition during periods when traffic volume is high.

18. The method of claim 15 further comprising controlling traffic lights when traffic is detected approaching the doorway from both the cold storage room and the anteroom so that the traffic in one of the cold storage room and the anteroom is allowed through the doorway and so that the traffic in the other of the cold storage room and the anteroom is stopped.

19. The method of claim 15 wherein the determining of a moisture level in the anteroom comprises determining a dew point temperature for the anteroom.

20. The method of claim 15 wherein the supplying of cold air from the cold storage room to the anteroom comprises energizing at least one transfer fan to transfer cold air from the cold storage room to the anteroom.

21. The method of claim 20 wherein the energizing of at least one transfer fan to transfer air from the cold storage room to the anteroom is performed only if the moisture level exceeds a predetermined level.

22. The method of claim 15 further comprising:

detecting frost near the doorway; and, controlling a fan coil unit in the anteroom to heat in response to the detected frost.

23. The method of claim 15 further comprising:

detecting frost on a coil of a cooling apparatus located in the cold storage room; and, increasing the speed of a fan of the cooling apparatus in response to the detected frost.

24. The method of claim 15 further comprising:

detecting frost near the doorway; and, operating a coil evaporator pressure regulator relay of a cooling apparatus in the cold storage room to increase suction pressure in response to the detected frost.

25. The method of claim 15 further comprising controlling a fan coil unit in the anteroom to heat if a condition in the anteroom is less than a set point by a predetermined amount.

26. The method of claim 15 wherein the determining of a moisture level in the anteroom comprises determining an actual dew point temperature of the anteroom, and wherein the supplying of cold air from the cold storage room to the anteroom comprises supplying cold air from the cold storage room to the anteroom when the actual dew point temperature of the anteroom is greater than an optimum dew point temperature for the anteroom.

27. The method of claim 26 wherein the optimum dew point temperature is selected to prevent the frost formation in the cold storage room.

28. The method of claim 26 further comprising:

determining a dry bulb temperature of the cold storage room;

determining a relative humidity of the cold storage room; and, determining the optimum dew point temperature according to a line on the psychometric chart, wherein the line passes through a first point established by the dry bulb temperature and the relative humidity of the cold storage room, wherein the line is tangent to the saturation curve of the psychometric chart, wherein the optimum dew point temperature is determined from a second point on the line established by the intersection of the tangent line and the desired anteroom dry bulb temperature line.

29. The method of claim 1 wherein the supplying of cold air from the cold storage room to the anteroom comprises opening a door in the doorway to permit cold air from the cold storage room to enter the anteroom.

30. The method of claim 1 wherein the supplying of cold air from the cold storage room to the anteroom comprises energizing at least one transfer fan to transfer cold air from the cold storage room to the anteroom.

31. The method of claim 30 wherein the supplying of cold air from the cold storage room to the anteroom further comprises opening a door in the doorway to permit cold air from the cold storage room to enter the anteroom.

32. The method of claim 30 wherein the energizing of at least one transfer fan to transfer cold air from the cold storage room to the anteroom is performed only if the moisture level in the anteroom exceeds a predetermined level.

33. The method of claim 1 further comprising:

detecting frost near the doorway; and, controlling a fan coil unit in the anteroom to heat in response to the detected frost.

34. The method of claim 1 further comprising:

detecting frost on a coil of a cooling apparatus located in the cold storage room; and, increasing the speed of a fan of the cooling apparatus in response to the detected frost.

35. The method of claim 1 further comprising:

detecting frost near the doorway; and, operating a coil evaporator pressure regulator relay of a cooling apparatus in the cold storage room to increase suction pressure in response to the detected frost.

* * * * *